US009925653B2

(12) United States Patent
Staas et al.

(10) Patent No.: US 9,925,653 B2
(45) Date of Patent: Mar. 27, 2018

(54) HAMMER DRILL

(71) Applicant: Black & Decker Inc., Newark, DE (US)

(72) Inventors: Ernst Staas, Limburg (DE); Stefan Gensmann, Frucht (DE); Achim Buchholz, Limburg (DE)

(73) Assignee: Black & Decker Inc., New Britain, CT (US)

( * ) Notice: Subject to any disclaimer, the term of this patent is extended or adjusted under 35 U.S.C. 154(b) by 533 days.

(21) Appl. No.: 14/317,985

(22) Filed: Jun. 27, 2014

(65) Prior Publication Data

US 2015/0014009 A1 Jan. 15, 2015

(30) Foreign Application Priority Data

Jul. 5, 2013 (EP) ..... 13175382

(51) Int. Cl.
*B25D 16/00* (2006.01)
*B25D 11/12* (2006.01)

(52) U.S. Cl.
CPC ..... *B25D 16/006* (2013.01); *B25D 11/12* (2013.01); *B25D 16/00* (2013.01);
(Continued)

(58) Field of Classification Search
CPC ..... B25D 16/006; B25D 11/12; B25D 16/00; F16H 3/08
(Continued)

(56) References Cited

U.S. PATENT DOCUMENTS 3,114,423 A * 12/1963 Naslund ..... B25D 16/00 173/14
3,256,944 A 6/1966 Hotzapfel
(Continued)

FOREIGN PATENT DOCUMENTS

CN 2614107 5/2004
CN 101422893 5/2009
(Continued)

OTHER PUBLICATIONS

Chinese Office Action dated Apr. 18, 2017 issued in Corresponding Chinese Patent Application 201410321271.7.
(Continued)

*Primary Examiner* — Nathaniel Chukwurah
(74) *Attorney, Agent, or Firm* — Amir R. Rohani

(57) ABSTRACT

A hammer drill comprises a motor including an output shaft, a shaft assembly rotationally engaged therewith, a hollow spindle, and a hammer mechanism comprising a piston arranged for reciprocating motion within the spindle. The shaft assembly comprises a first part carrying a first gear engaged with a gear on the spindle to cause spindle rotation, a second part carrying a crank member to cause piston reciprocation, and a connecting part configured to rotationally interconnect, or disconnect, the first and second parts. In a first position of the connecting part only one of the first and second parts is rotationally engaged with the output shaft to enable rotation of only one of the first gear and the crank member respectively, while in a second position both the first and second parts are rotationally engaged with the output shaft to enable rotation of both the first gear and the crank member.

18 Claims, 6 Drawing Sheets

(52) U.S. Cl.
CPC .. *B25D 2211/003* (2013.01); *B25D 2211/068* (2013.01); *B25D 2216/0023* (2013.01); *B25D 2216/0038* (2013.01); *B25D 2250/051* (2013.01)

(58) Field of Classification Search
USPC ..... 173/47, 48, 104, 109, 201, 210, 211; 74/329, 331
See application file for complete search history.

(56) References Cited

U.S. PATENT DOCUMENTS

| | | | | |
|---|---|---|---|---|
| 3,269,466 | A * | 8/1966 | Mitchell | B25D 11/005 173/103 |
| 3,507,337 | A | 4/1970 | Chromy | |
| 3,896,888 | A | 7/1975 | Badcock | |
| 4,194,435 | A | 3/1980 | Gaun et al. | |
| 4,266,465 | A | 5/1981 | Gaun et al. | |
| 4,283,991 | A | 8/1981 | Gaun et al. | |
| 4,290,492 | A | 9/1981 | Sides et al. | |
| 4,611,670 | A | 9/1986 | Chromy | |
| 4,732,217 | A | 3/1988 | Bleicher et al. | |
| 5,775,441 | A | 7/1998 | Sakuragi et al. | |
| 6,523,622 | B1 | 2/2003 | Berger et al. | |
| 6,644,418 | B2 | 11/2003 | Haga | |
| 6,938,704 | B2 | 9/2005 | Berger et al. | |
| 7,252,157 | B2 | 8/2007 | Aoki | |
| 7,306,048 | B2 | 12/2007 | Yamazaki | |
| 7,306,049 | B2 * | 12/2007 | Soika | B25D 16/006 173/109 |
| 7,322,427 | B2 | 1/2008 | Shimma et al. | |
| 7,325,624 | B2 | 2/2008 | Yamazaki | |
| 7,383,895 | B2 | 6/2008 | Aoki | |
| 7,523,791 | B2 | 4/2009 | Aoki | |
| 7,694,750 | B2 | 4/2010 | Tsubakimoto et al. | |
| 7,726,414 | B2 | 6/2010 | Berger et al. | |
| 7,828,074 | B2 | 11/2010 | Tsubakimoto et al. | |
| 7,878,265 | B2 | 2/2011 | Aoki | |
| 2009/0101376 | A1 | 4/2009 | Walker et al. | |
| 2010/0155094 | A1 | 6/2010 | Ikuta et al. | |
| 2011/0247848 | A1 | 10/2011 | Sieber et al. | |

FOREIGN PATENT DOCUMENTS

| | | |
|---|---|---|
| DE | 1196608 | 10/1962 |
| DE | 1969990 | 7/1967 |
| DE | 1652685 | 12/1970 |
| DE | 2339822 | 2/1975 |
| DE | 2709616 | 9/1978 |
| DE | 8015639 | 9/1980 |
| DE | 3320426 | 12/1984 |
| DE | 3329005 | 2/1985 |
| DE | 3932134 | 4/1991 |
| DE | 19713154 | 10/1997 |
| DE | 19628946 | 1/1998 |
| DE | 19815650 | 12/1998 |
| DE | 19810088 | 8/1999 |
| DE | 19825410 | 12/1999 |
| DE | 19847687 | 4/2000 |
| DE | 10253421 | 6/2003 |
| DE | 102004060852 | 7/2005 |
| DE | 102006010892 | 9/2007 |
| DE | 1020080541158 | 6/2010 |
| DE | 102010001683 | 8/2011 |
| EP | 0546624 | 6/1993 |
| EP | 0759341 | 2/1997 |
| EP | 0876880 | 11/1998 |
| EP | 0876881 | 11/1998 |
| EP | 0084138 | 12/1998 |
| EP | 1117508 | 8/1999 |
| EP | 1425138 | 9/2002 |
| EP | 1648663 | 7/2004 |
| EP | 1661667 | 5/2006 |
| EP | 1893388 | 6/2006 |
| EP | 2212063 | 9/2008 |
| EP | 2130652 | 12/2009 |
| EP | 2281662 | 2/2011 |
| GB | 2086777 | 5/1982 |
| GB | 2 413 611 | 11/2005 |
| WO | 0016948 | 3/2000 |
| WO | 03024672 | 3/2003 |
| WO | 2005009688 | 2/2005 |
| WO | 2006136401 | 12/2006 |
| WO | 2009053139 | 4/2009 |

OTHER PUBLICATIONS

EP Search Report dated Apr. 15, 2014 issued in corresponding EP application No. 13175382.4.
CNOA dated Jan. 2, 2018 issued in corresponding CN application No. 201410321271.7.

* cited by examiner

HAMMER DRILL

CROSS-REFERENCE TO RELATED APPLICATIONS

This application claims priority, under 35 U.S.C. § 119, to European Patent Application No. 13175382.4 filed Jul. 5, 2013, titled "Hammer Drill," incorporated herein by reference in its entirety.

FIELD OF THE INVENTION

The present invention relates to hammer drills, and especially to mode change arrangements of hammer drills.

BACKGROUND OF THE INVENTION

U.S. Pat. No. 3,269,466 discloses a hammer drill having a single shaft intermediate the output shaft of the motor and the hollow spindle, carrying both a bevel gear to rotate the spindle and a crank member to drive the piston of the hammer mechanism, the intermediate shaft being perpendicular to the axis of the spindle due to the use of a crank member. Such a single intermediate shaft provides the dual advantages of compactness and reduced weight, compared to a conventional hammer drill having two, intermediate shafts (one shaft to rotate the spindle and the other shaft to rotate the crank member). In the hammer drill of U.S. Pat. No. 3,269,466, because the crank member drives the piston inside the hollow spindle, and the bevel gear on the intermediate shaft engages the bevel gear on the hollow spindle, the distance between the crank member and the bevel gear on the intermediate shaft is tightly constrained, with the bevel gear located between the crank member and the engagement with the output shaft of the motor. Because the intermediate shaft causes both the hollow spindle and the crank member to rotate, the drill inevitably always performs both drilling (rotational) and hammering (longitudinal) actions in use. In order to choose whether an attached tool bit is only rotated, only hammered, or both rotated and hammered, the user must choose a tool bit having an appropriate design of shank. However, regardless of the design of tool bit shank, the internal mechanism of the hammer drill always performs both rotational and hammering actions when when the motor is operated. Consequently, when only one, of the actions is required, the energy expended on the other action is wasted, and unnecessary vibrations are produced.

U.S. Pat. No. 4,895,212 discloses a hammer drill having a single shaft intermediate the output shaft of the motor and the hollow spindle, the intermediate shaft carrying both a gear to rotate the spindle and a wobble drive to cause the piston of the hammer mechanism to reciprocate, and the intermediate shaft being parallel to the axis of the spindle due to the use of a wobble drive. As is conventional, the wobble drive (comprising a rotational hub carrying an obliquely arranged arm on a bearing arrangement) is located adjacent to the motor output spindle so as to be behind the hollow spindle, and thus the gear on the intermediate shaft which rotates the hollow spindle is located on the opposite side of the wobble drive to the engagement with the output shaft of the motor. Consequently, in the hammer drill of U.S. Pat. No. 4,895,212 the intermediate shaft can be sufficiently long, between the wobble drive and the gear which rotates the spindle, for a mode change mechanism to be provided, to enable the wobble drive to be turned on or off.

European Patent Application EP 1857228 A1 discloses a mode change mechanism for a hammer or percussion drill driver of the type in which the hammer or percussion action is provided by a ratchet mechanism rather than by a piston driven by a crank member or wobble drive. The mode change mechanism includes a rotatable collar having a cam surface which moves an elongate member when the collar is rotated, to change the operating mode of the drill driver.

U.S. Pat. No. 5,435,397 discloses a hammer drill having a hollow spindle and a hammer mechanism including a piston driven by a wobble drive. The hammer drill includes a rotatable collar which opens and closes vent openings in the hollow spindle, to vary the impact energy provided by the pneumatic hammer mechanism.

BRIEF SUMMARY OF THE INVENTION

In a first aspect, the present invention provides a hammer drill, comprising: a motor including a motor output shaft; a hollow spindle; a hammer mechanism comprising a piston arranged for reciprocating motion within the hollow spindle; and an intermediate shaft assembly rotationally engaged with the motor output shaft and comprising a first part, a second part and a connecting part, the first part carrying a first gear which is in engagement with a second gear on the hollow spindle to cause rotation of the spindle, the second part carrying a crank member arranged to cause the reciprocating motion of the piston, and the connecting part arranged for movement with respect to the first and second parts to rotationally interconnect, or disconnect, the first and second parts such that in a first position of the connecting part only one of the first and second parts is rotationally engaged with the motor output shaft to enable rotation of only one of the first gear and the crank member respectively, and such that in a second position of the connecting part both of the first and second parts are rotationally engaged with the motor output shaft to enable rotation of both the first gear and the crank member.

The first part of the intermediate shaft assembly preferably comprises a hollow part, and the second part preferably extends at least partly through the first part.

Advantageously, the first part may carry a driven gear which is in engagement with the motor output shaft and which is arranged to rotate the first part when the motor output shaft rotates in use.

The first gear preferably is formed in a single piece with the first part, but alternatively the first gear could be a separate part attached to the first part. The second gear may be formed in a single piece with the hollow spindle, but preferably the second gear is a separate part attached to the spindle. The first gear and/or the second gear preferably comprise a bevel gear, and more preferably both the first and second gears comprise bevel gears. Alternatively, however, either the first gear or the second gear may comprise a bevel gear in the form of a crown gear (i.e. a bevel gear in which the pitch angle is ninety degrees), and the other gear may comprise a conventional gear, for example.

The second part of the intermediate shaft assembly preferably comprises a shaft which extends at least partly through the first part and preferably beyond two opposite ends of the first part. The crank member preferably is located at one end region of the second part which extends beyond an end of the first part. A region of the second part on which the connecting part is located, or locatable, preferably comprises one end region of the second part which extends beyond an end of the first part. The end region of the second part on which the connecting part preferably is located, or locatable, preferably is the opposite end region to the end region of the second part at which the crank member is located.

In preferred embodiments of the invention, when the connecting part of the intermediate shaft assembly is in its first position the connecting part is located on only one of the first and second parts, and when the connecting part is in its second position the connecting part is located on both of the first and second parts. More preferably, when the connecting part is in its first position the connecting part is located on only the second part, e.g. to enable rotation of only the first gear and not the crank member. The connecting part preferably comprises a hollow part located on the first part and/or the second part.

The hammer drill of the first aspect of the invention preferably further comprises a movable linkage arrangement configured to move the connecting part of the intermediate shaft assembly between its first and second positions. More preferably, the hammer drill further comprises a mode change collar rotatably mounted on a housing of the hammer drill and configured such that rotation of the mode change collar causes the movable linkage arrangement to move the connecting part between its first and second positions.

Accordingly, a second aspect of the invention provides a hammer drill, comprising: a housing; a motor including a motor output shaft; a hollow spindle; a hammer mechanism comprising a piston arranged for reciprocating motion within the hollow spindle; an intermediate shaft assembly rotationally engaged with the motor output shaft and comprising a first part, a second part and a connecting part, the first part carrying a first gear which is in engagement with a second gear on the hollow spindle to cause rotation of the spindle, the second part carrying a motion conversion member arranged to cause the reciprocating motion of the piston, and the connecting part arranged for movement with respect to the first and second parts to rotationally interconnect, or disconnect, the first and second parts such that in a first position of the connecting part only one of the first and second parts is rotationally engaged with the motor output shaft to enable rotation of only one of the first gear and the motion conversion member respectively, and such that in a second position of the connecting part both of the first and second parts are rotationally engaged with the motor output shaft to enable rotation of both the first gear and the motion conversion member; a movable linkage arrangement configured to move the connecting part between its first and second positions; and a mode change collar rotatably mounted on the housing and configured such that rotation of the mode change collar causes the movable linkage arrangement to move the connecting part between its first and second positions.

It is to be understood that any feature, including any preferred feature, of an aspect of the invention may be a feature, including a preferred feature, of another aspect of the invention.

The motion conversion member of the second aspect of the invention may, for example, comprise a crank member.

The movable linkage arrangement of both aspects of the invention may, for example, comprise a pivoting arm. Advantageously, the movable linkage arrangement may comprise an elongate member configured to pivot the pivoting arm. The mode change collar preferably includes a cam surface configured such that rotation of the mode change collar causes the elongate member to move. The pivoting arm preferably is spring-biased towards the elongate member and the mode change collar.

BRIEF DESCRIPTION OF THE DRAWINGS

Preferred embodiments of the invention will now be described, by way of example, with reference to the accompanying drawings, of which.

DETAILED DESCRIPTION OF THE INVENTION

Figure 1A:
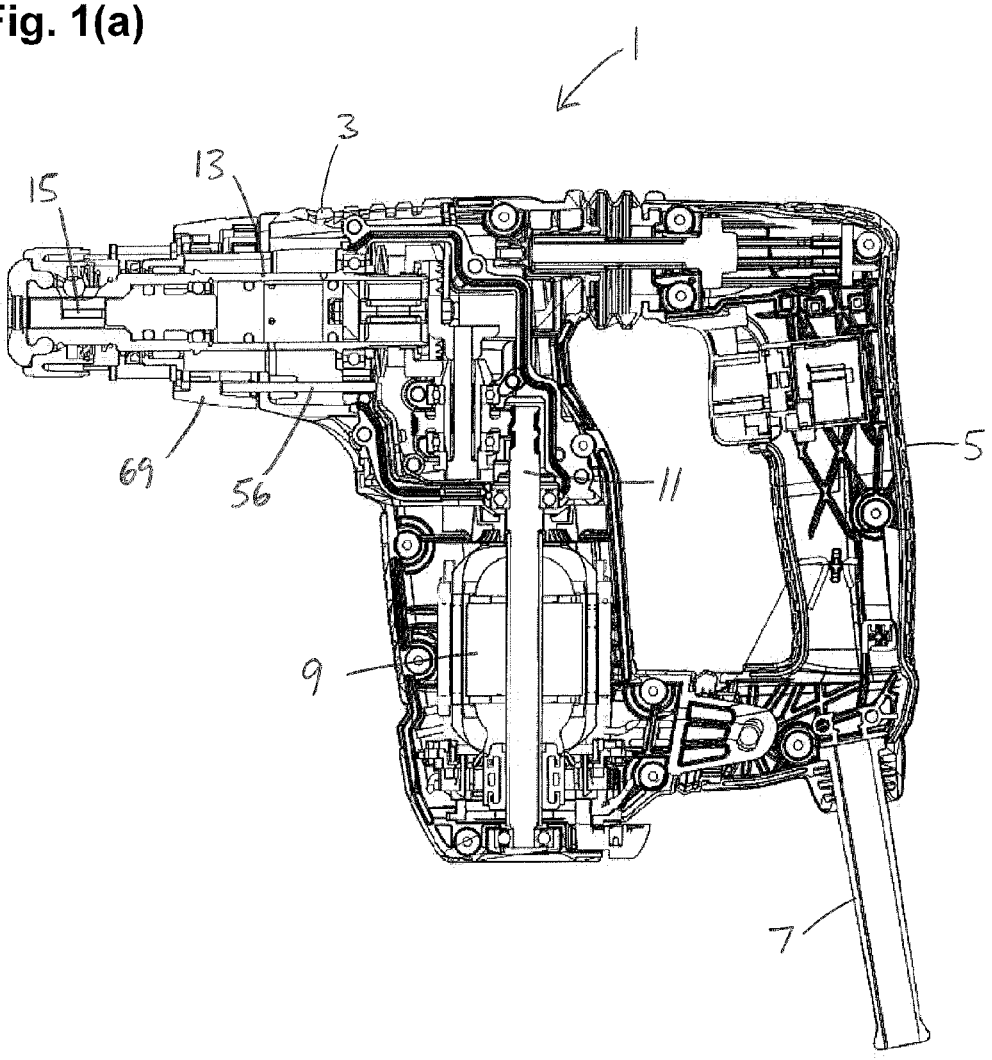
FIG. 1 (views (*a*) and (*b*)) shows an embodiment of a hammer drill according to the invention.
Figure 1B:
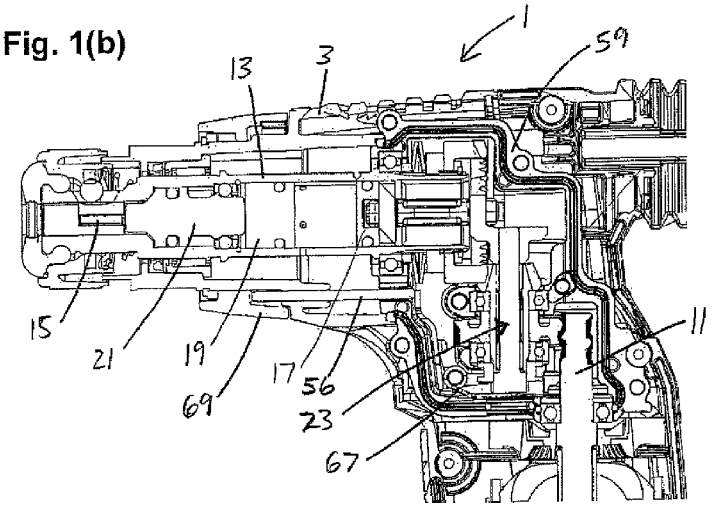

FIG. 1(*a*) shows an embodiment of a hammer drill 1 according to the invention, comprising a main housing 3 including a handle 5 with an electrical power cord protector 7 extending therefrom. The hammer drill 1 includes an electric motor 9 which includes a motor output shaft 11. A hollow spindle 13 of the hammer drill 1 includes a conventional tool holder 15 for holding tools such as drill bits or chisels (not shown), and thus the hollow spindle may be referred to as a tool spindle. The hammer drill 1 includes a conventional pneumatic hammer mechanism which is shown more clearly in FIG. 1(*b*).

The pneumatic hammer mechanism of the hammer drill 1 comprises a piston 17 located in the hollow spindle 13 and arranged for reciprocating motion. Also located in the hollow spindle 13 and arranged for reciprocating motion are a ram 19 and a beat piece 21. As already mentioned, the pneumatic hammer mechanism comprising the piston 17, ram 19 and beat piece 21 are conventional, and so will not be described further. The hammer drill 1 also includes an intermediate shaft assembly 23 which is shown more clearly in FIGS. 2 and 3.

The intermediate shaft assembly 23 of the hammer drill 1 comprises a hollow first part 25, an elongate second part 27 extending through the first part, and a hollow connecting part 29 movably located on the first and second parts.

The first part 25 of the intermediate shaft assembly 23 carries a driven gear 31 which is press-fit thereon (but which could instead be integral therewith) and which is in engagement with the motor output shaft 11. Consequently, when the motor output shaft 11 rotates in use, the first part 25 of the intermediate shaft assembly 23 also rotates. The first part 25 also carries a first gear 33 which is in engagement with a second gear 35 on the hollow spindle 13 to cause rotation of the hollow spindle when the motor output shaft 11 rotates in use. In the illustrated embodiment of the invention, both the first and second gears are bevel gears, but instead one of the gears may be a crown gear and the other gear may be a conventional gear, for example. Also in the illustrated embodiment, the first gear 33 is formed in a single piece with the first part 25 of the intermediate shaft assembly, and the second gear 35 is a separate part which is attached to the hollow spindle 13. However, in alternative embodiments both the first and second gears may be formed integrally with the components carrying them (the first part 25 and the hollow spindle 13, respectively) or the first gear 33 may be a separate component which is attached to the first part 25 and the second gear 35 may be formed integrally with the hollow spindle 13.

The second part 27 of the intermediate shaft assembly 23 is in the form of a shaft and carries a crank member 37 which is arranged to cause the reciprocating motion of the piston 17. An eccentrically located crank pin 39 of the crank member 37 is connected to a connecting rod 41 which interconnects the crank member 37 with the piston 17, in a conventional manner. The crank member 37 is attached to (e.g. press-fit on) the second part 27, but could instead be integrally formed therewith. The crank member 37 is located adjacent to the first gear 33, on an end region 43 of the second part 27 which extends beyond an end of the first part 25.

The hollow connecting part 29 of the intermediate shaft assembly 23 is movably located on an opposite end region 45 of the second part 27. As most clearly shown in views 2(*b*), 2(*c*) and 3(*b*), the end region 45 of the second part 27, and an adjacent region 47 of the first part 25, include matching splines 49 and 50, respectively. Additionally, the end region 45 of the second part 27 has an increased diameter to match the diameter of the adjacent region 47 of the first part 25. The hollow connecting part 29 has the form of a ring, the internal surface 51 of which includes splines which are configured to locate between the corresponding splines of the first and second parts.

Figure 2A:
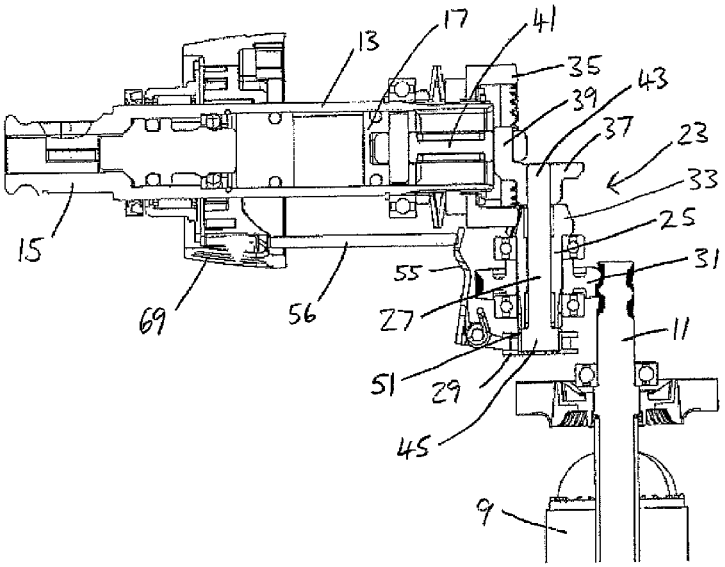
FIG. 2 (views (*a*) to (*c*)) shows a detail of the hammer drill, in drilling-only mode.
Figure 2B:
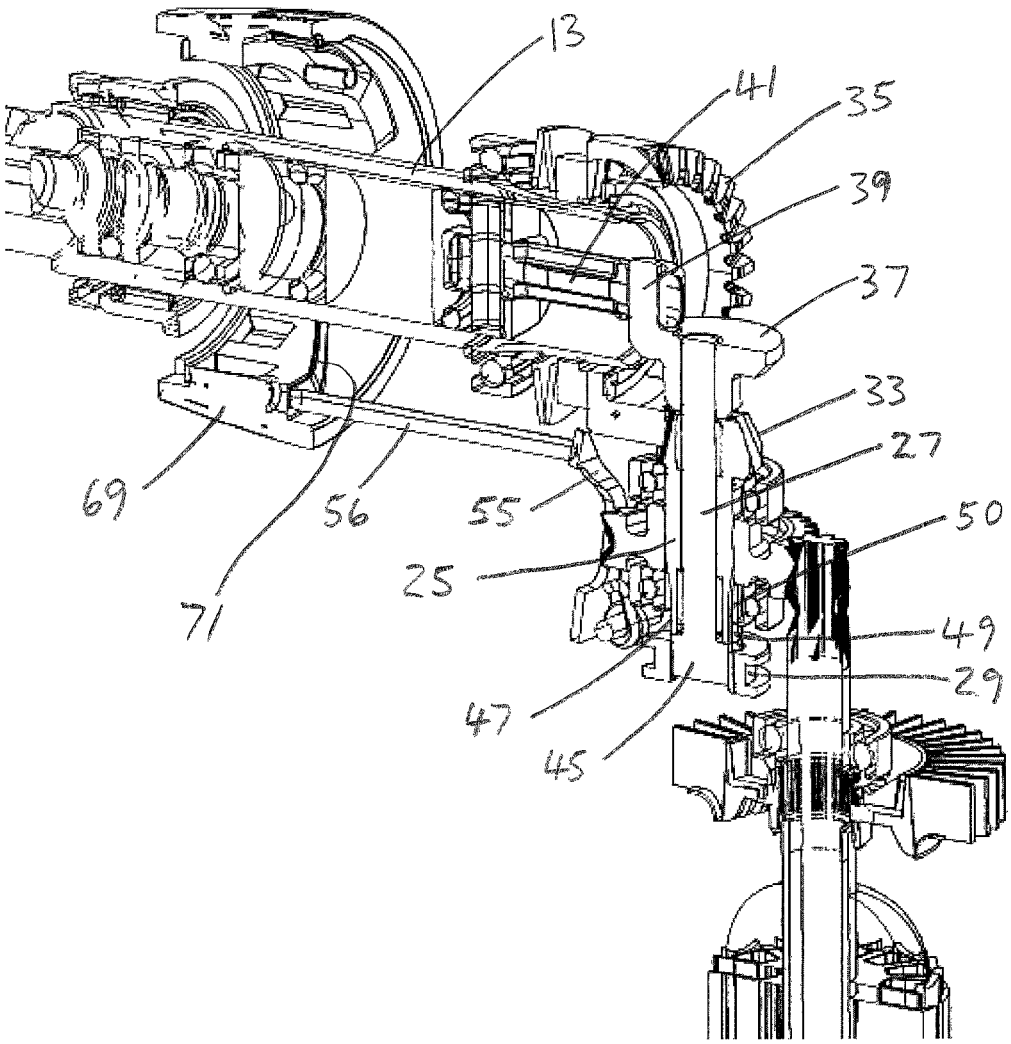
Figure 2C:
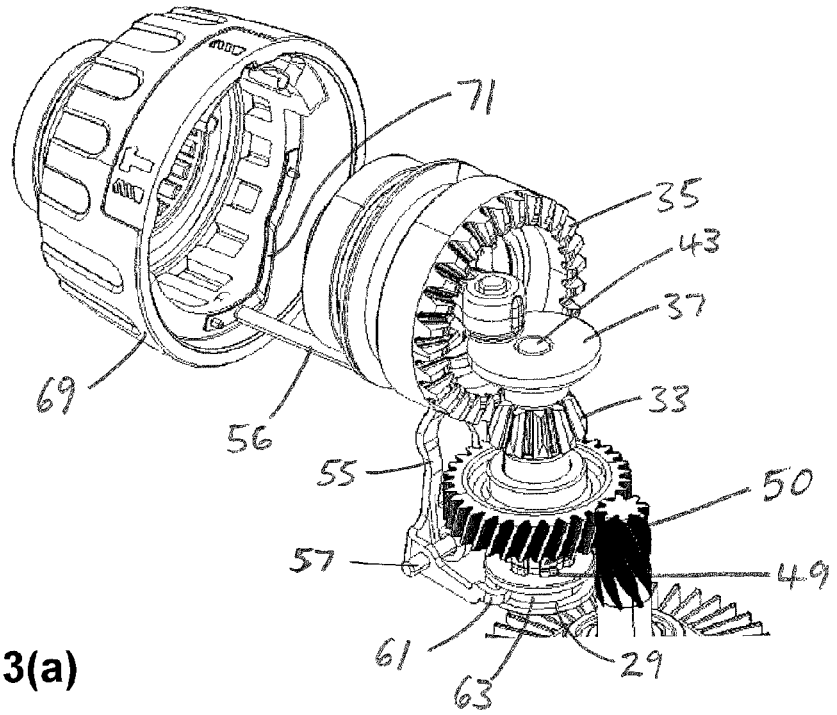

As shown in FIG. 2, a first position of the connecting part 29 is such that it is located on only the second part 27. Consequently, when the connecting part 29 is in its first position, the first and second parts are rotationally disconnected from each other so that rotation of the motor output shaft 11, which causes rotation of the first part 25, does not cause rotation of the second part 27. Therefore, when the connecting part 29 is in its first position, the hollow spindle 13 is caused to rotate but the crank member 37 is not caused to rotate, and thus the hammer drill is in drilling-only mode.

Figure 3A:
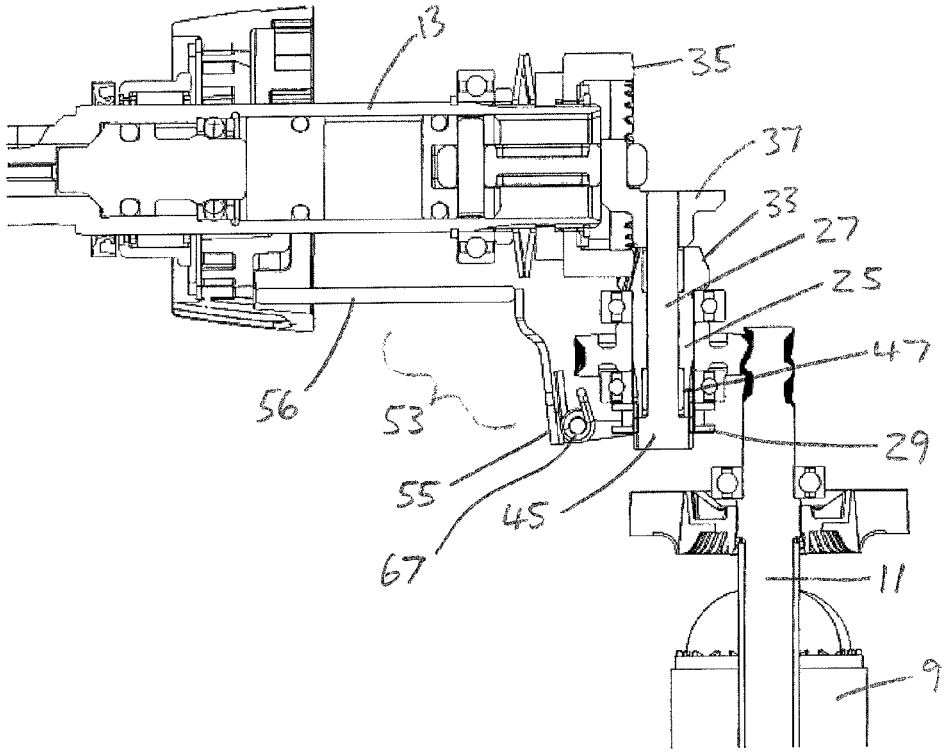
FIG. 3 (views (*a*) to (*c*)) shows a detail of the hammer drill, in hammer drilling mode.
Figure 3B:
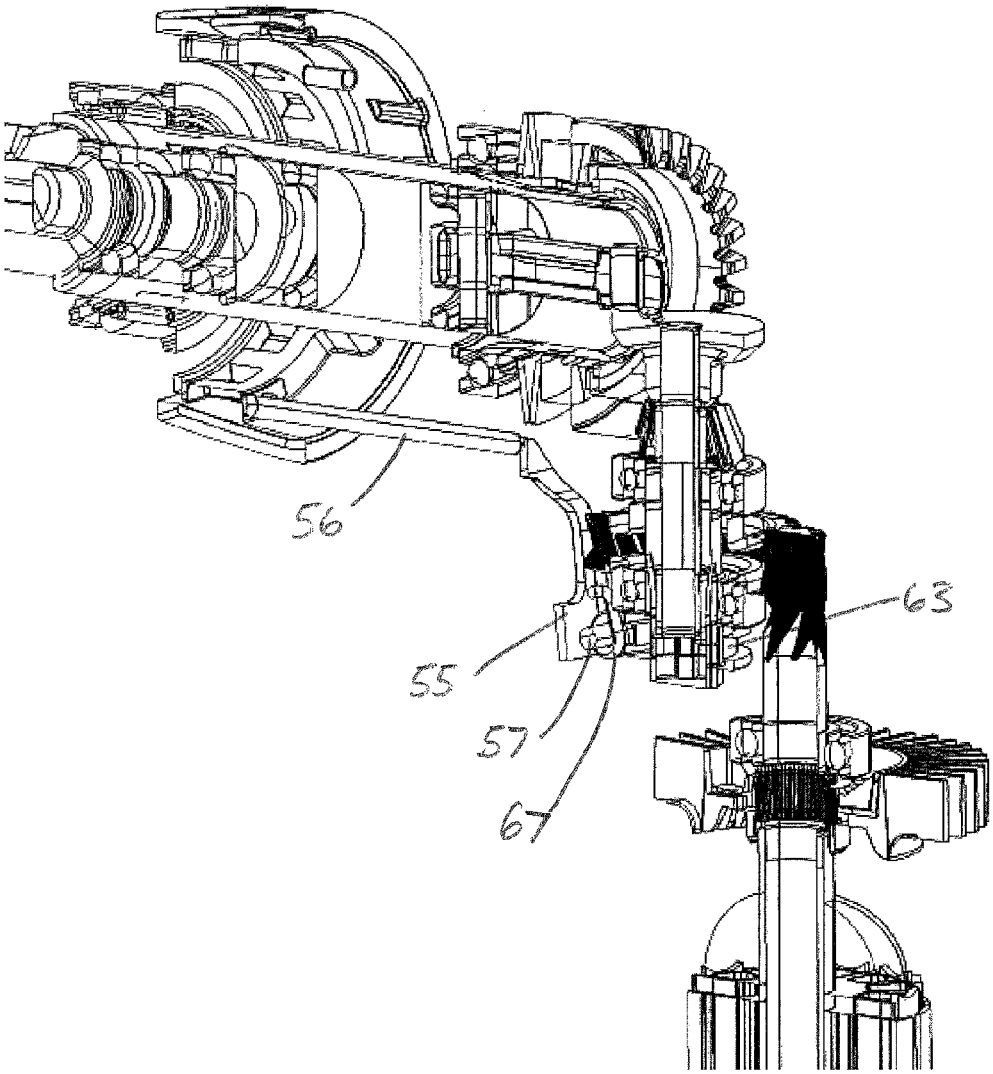
Figure 3C:
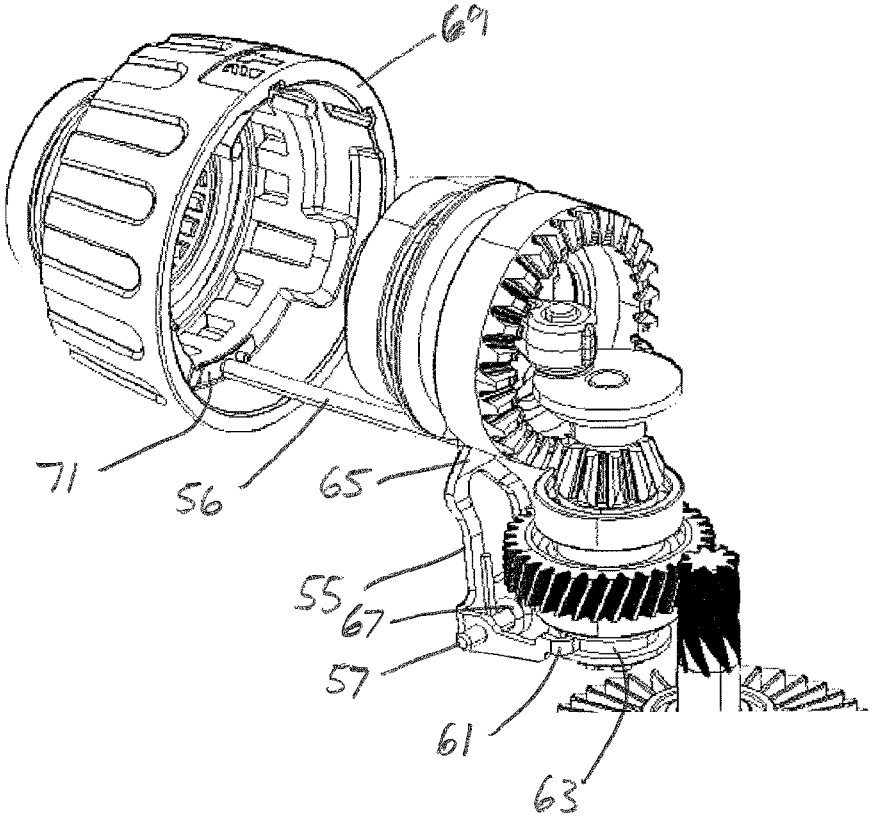

As shown in FIG. 3, a second position of the connecting part 29 is such that it is located on both the second part 27 and the first part 25, i.e. it extends between the end region 45 of the second part and the adjacent region 47 of the first part. Because the splines of the hollow connecting part 29 are located between corresponding splines 49 and 50 of both the second and first parts (respectively), when the connecting part 29 is in its second position, the first and second parts are rotationally interconnected. This has the consequence that rotation of the motor output shaft 11, which causes rotation of the first part 25, also causes rotation of the second part 27. Therefore, when the connecting part 29 is in its second position, the hollow spindle 13 is caused to rotate and the crank member 37 is also caused to rotate, and thus the hammer drill is in hammer drilling mode.

The hollow connecting part 29 is movable with respect to the first part 25 and second part 27 of the intermediate shaft assembly 23 by means of a movable linkage arrangement 53. The movable linkage arrangement 53 comprises a pivoting arm 55 and a substantially rigid elongate member 56. The pivoting arm 55 is arranged to pivot about a pivot rod 57, opposite ends of the pivot rod being rotatably located in corresponding recesses in an inner housing 59 of the hammer drill 1. The pivoting arm 55 has two opposite end portions, a first of which comprises a pair of end members 61 located in a groove 63 provided on the exterior of the hollow connecting part 29, and the second end portion 65 of the pivoting arm abuts an end of the elongate member 56. The pivoting arm 55 is spring-biased by means of a spring 67 such that the second end portion 65 is biased towards the elongate member 56. As shown in FIG. 1, the spring 67 biases the pivoting arm 55 away from a region of the inner housing 59 against which a portion of the spring engages. Also as shown in FIG. 1, the elongate member 56 extends through respective openings in the inner housing 59 and the main housing 3, parallel to the hollow spindle 13, and extends into a mode change collar 69 which is rotatably mounted on the exterior of the main housing 3 near the tool holder 15.

As best shown in FIGS. 2(*b*) and 2(*c*), the interior of the mode change collar 69 includes a cam surface 71 configured such that rotation of the mode change collar with respect to the main housing 3 causes the elongate member 56 to move longitudinally towards, or away from, the intermediate shaft assembly 23. Such longitudinal movement of the elongate member 56 causes the pivoting arm 55 to pivot (rotate), thereby causing the hollow connecting part 29 to move with respect to the first part 25 and second part 27 of the intermediate shaft assembly 23. In this way, rotation of the mode change collar 69 causes the operating mode of the hammer drill to be changed between hammer drilling mode and drilling-only mode.

It will be understood that the above description and the drawings are of particular examples of the invention, but that other examples of the invention are included in the scope of the claims.

The invention claimed is:

1. A hammer drill, comprising:

a motor including a motor output shaft;

a hollow spindle;

a hammer mechanism comprising a piston arranged for reciprocating motion within the hollow spindle; and an intermediate shaft assembly rotationally engaged with the motor output shaft and comprising a first part, a second part and a connecting part, the first part carrying a first gear which is in engagement with a second gear on the hollow spindle to cause rotation of the spindle, the second part carrying a crank member arranged to cause the reciprocating motion of the piston, and the connecting part arranged for movement with respect to the first and second parts to rotationally interconnect, or disconnect, the first and second parts such that in a first position of the connecting part only one of the first and second parts is rotationally engaged with the motor output shaft to enable rotation of only one of the first gear and the crank member respectively, and such that in a second position of the connecting part both of the first and second parts are rotationally engaged with the motor output shaft to enable rotation of both the first gear and the crank member, wherein the second part comprises a shaft which extends through the first part and an end region that extends beyond an end of the first part, and wherein the connecting part is located or locatable on the end region of the second part.

2. A hammer drill according to claim 1, wherein the first part comprises a hollow part, and the second part extends through the first part.

3. A hammer drill according to claim 1, wherein the first part carries a driven gear which is in engagement with the motor output shaft and is arranged to rotate the first part when the motor output shaft rotates in use.

4. A hammer drill according to claim 1, wherein the first gear is formed in a single piece with the first part.

5. A hammer drill according to claim 1, wherein one or more of the first gear and the second gear comprises a bevel gear.

6. A hammer drill according to claim 5, wherein the bevel gear comprises a crown gear.

7. A hammer drill according to claim 1, wherein the shaft of the second part extends beyond two opposite ends of the first part.

8. A hammer drill according to claim 7, wherein the crank member is located at another end region of the second part which extends beyond an end of the first part opposite the connecting part.

9. A hammer drill according to claim 1, wherein when the connecting part is in its first position the connecting part is located on only one of the first and second parts, and when the connecting part is in its second position the connecting part is located on both of the first and second parts.

10. A hammer drill according to claim 9, wherein when the connecting part is in its first position the connecting part is located on only the second part to enable rotation of only the first gear and not the crank member.

11. A hammer drill according to claim 1, wherein the connecting part comprises a hollow part located on the first part and/or the second part.

12. A hammer drill according to claim 1, further comprising a movable linkage arrangement configured to move the connecting part between its first and second positions.

13. A hammer drill according to claim 12, further comprising a mode change collar rotatably mounted on a housing of the hammer drill and configured such that rotation of the mode change collar causes the movable linkage arrangement to move the connecting part between its first and second positions.

14. The hammer drill according to claim 13, wherein the movable linkage arrangement comprises an elongate member configured to pivot the pivoting arm, and wherein the mode change collar includes a cam surface configured such that rotation of the mode change collar causes the elongate member to move.

15. A hammer drill according to claim 14, wherein the pivoting arm is spring-biased towards the elongate member and the mode change collar.

16. A hammer drill according to claim 1, further comprising:

a housing;

a movable linkage arrangement configured to move the connecting part between its first and second positions; and a mode change collar rotatably mounted on the housing and configured such that rotation of the mode change collar causes the movable linkage arrangement to move the connecting part between its first and second positions.

17. A hammer drill according to claim 16, wherein the movable linkage arrangement comprises a pivoting arm.

18. A hammer drill according to claim 16, wherein the movable linkage arrangement comprises an elongate member configured to pivot the pivoting arm.

* * * * *